US006415125B1

(12) United States Patent
Yamamoto et al.

(10) Patent No.: US 6,415,125 B1
(45) Date of Patent: Jul. 2, 2002

(54) DEVELOPING APPARATUS FEATURING AN AREA WHERE A PARTLY EXPOSED DEVELOPER AGITATING MEMBER AND CONVEYING MEMBER ARE DISPOSED

(75) Inventors: Shinya Yamamoto, Numazu; Hiroaki Ogata, Shizuoka-ken, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/661,282

(22) Filed: Sep. 14, 2000

(30) Foreign Application Priority Data

Sep. 20, 1999 (JP) ..... 11-266380
Dec. 9, 1999 (JP) ..... 11-350464

(51) Int. Cl.[7] ..... G03G 15/08
(52) U.S. Cl. ..... 399/254; 399/255; 399/260
(58) Field of Search ..... 399/254–256, 399/258–260

(56) References Cited

U.S. PATENT DOCUMENTS 4,496,240 A * 1/1985 Yamashita et al. ..... 399/260 X

* cited by examiner

*Primary Examiner*—William J. Royer
(74) *Attorney, Agent, or Firm*—Fitzpatrick, Cella, Harper & Scinto

(57) ABSTRACT

A developing apparatus and an image forming apparatus for agitating a two-component developer throughly in a short time, feeds a developer with an even toner concentration to a developer bearing body and stably forms a high-quality image free from defects at any time. A developer agitating and conveying assembly, which is provided in a developer container agitates and conveys the developer. A toner feed port feeds toner to the developer container. The agitating and conveying members are disposed to be partially exposed out of the developer.

24 Claims, 9 Drawing Sheets

DEVELOPING APPARATUS FEATURING AN AREA WHERE A PARTLY EXPOSED DEVELOPER AGITATING MEMBER AND CONVEYING MEMBER ARE DISPOSED

BACKGROUND OF THE INVENTION

1. Field of the Invention

The present invention relates to a developing apparatus, an image forming apparatus, and a process cartridge which use a two-component developer to develop an electrostatic latent image formed on an image bearing member by an electronic photograph method, an electrostatic recording method, or the like, and relates to an electronic photograph image forming apparatus to which the process cartridge can be removably attached.

Here, image forming apparatuses and electronic photograph image forming apparatuses include copying machines, printers (such as LED printers and laser beam printers), fax machines, and word processors.

The process cartridge is defined as a cartridge into which at least charging means, developing means, or cleaning means and an electro-photosensitive body are integrated so that the cartridge can removably be attached to an electronic photograph image forming apparatus or as a cartridge into which at least developing means and an electro-photosensitive body are integrated so that the cartridge can be removably attached to an electronic photograph image forming apparatus.

2. Related Background Art

Conventionally, the so-called two-component developing method has been used as a developer which visualizes an electrostatic latent image formed on an image bearing member using a two-component developer which contains a nonmagnetic toner and a magnetic carrier.

The two-component developing method agitates a two-component developer using a developer agitating and carrying member disposed in a developer container containing the developer to electrostatically charge the toner by friction and then conveys the toner to a developing sleeve as a developer bearing member having a fixed magnet roller inside. Also, the developer is conveyed while being carried on the developing sleeve and fed to an electrostatic latent image to develop it.

In order to meet increasing needs for color copies (or documents printed in color) or save space, to be even smaller, inexpensive developing apparatuses have been being used. Process cartridges are widely used into which an electro-photosensitive body and processing means acting on the body are integrated so that they can be removably attached to an image forming apparatus. Because such a process cartridge allows a user himself to maintain an image forming apparatus independently of a service technician, the operability of the apparatus significantly increases. Thus process cartridges of this type are used in many electronic photograph image forming apparatuses.

The above-described developing apparatus and process cartridge hold a small amount of developer because the developing apparatus is installed in a limited space around an image bearing body. Thus by separately providing a toner feeder (hereinafter called a "hopper"), the developing apparatus is often adapted to feed only toner when the toner is consumed, reducing running cost.

FIG. 8 is a schematic sectional view of an example of a conventional developing apparatus. First and second agitating members 111 and 112 are disposed in a developer container 107, containing a two-component developer. In the figure, a hopper 114 which contains toner to be replenished is provided above the developer container 107. The hopper 114 is provided at its bottom with an opening, which is above the second agitating member 112. Near the opening, a toner feed member 116 is rotatably provided. In response to a signal from a toner sensor 113, that is, means for detecting the concentration of toner in developer, or toner amount detecting means, the toner feed member 116 rotates to feed toner from the hopper 114 to the developer container 107.

In response to a toner concentration detection signal from the toner sensor 113 in the developer container 107, the toner feed member 116 rotates to feed toner from the hopper 114. When the toner sensor 113 senses "toner is empty" which means that toner in the developer container 107 is below a predetermined level, the toner feed member 116 in the hopper 114 operates to replenish toner. Based on a value as detected when the toner sensor 113 senses "toner is empty (that toner in the developer container 107 is below the predetermined level), the amount of toner to be replenished is determined from a predetermined function.

After the toner is fed from the hopper 114 onto the second agitating member 112 in the developer container 107, the toner is replenished over the entire area along the length of the developer container 107 with the rotation of the second agitating member 112 and the first agitating member 111. The first and second agitating members 111 and 112, which are shaped like a screw propeller, can freely rotate in the directions indicated by arrows in the figure. The first and second agitating members 111 and 112 are also adapted to rotate in synchronism with a developing sleeve 104 or only when toner is fed.

Here, to form an image of a uniform density, it is essential to stably feed to the developing sleeve 104 a developer with a uniform concentration of toner to a photosensitive drum. It is preferably for stable feeding such a developer that toner is agitated immediately after it is replenished.

A method is known which conveys developer in the direction of the axis of the developing sleeve 104 to agitate the developer, using an agitating member, adapted by forming a spiral blade around a rotating shaft to enhance agitation performance. Another method is also known which agitates and conveys developer, using flat ribs extending divergently from a shaft to further enhance agitation performance.

However, it is difficult for the conventional developing apparatus and process cartridge to always satisfactorily agitate and convey a two-component developer, containing toner and a carrier, well irrespective of environmental changes and durability operation, resulting in a defect of a final image, such as an uneven density.

An uneven density of an image can be caused by insufficient agitation power of an agitating member. That is, it takes much time for toner fed from the hopper 114 to uniformly diffuse into the carrier, and thus developer is fed to the developing sleeve 104 before an even toner concentration is reached, resulting in an uneven image density.

Moreover, such insufficient agitation causes the toner sensor 113, developer amount detecting means, to malfunction. That is, because insufficiently agitated developer leaves a carrier and toner separated from each other, the toner sensor 113 continues to sense "toner is empty" and requires replenishment of toner.

SUMMARY OF THE INVENTION

It is an object of the present invention to provide a developing apparatus and an image forming apparatus which can produce a high-quality image stably.

It is another object of the present invention to provide a developing apparatus and an image forming apparatus which can agitate a two-component developer thoroughly in a short time, feed a developer with an even toner concentration to a developer bearing body, and stably form a high-quality image free from defects at any time.

It is still another object of the present invention to provide a developing apparatus and an image forming apparatus which can thoroughly agitate a two-component developer in a short time and prevent developer amount detecting means from malfunctioning.

It is a further object of the present invention to provide a developing apparatus, including: a developer container which holds a two-component developer containing magnetic particles and toner; a developer agitating and conveying member which is provided in the developer container to agitate and convey developer; and a toner feed port for feeding toner to the developer container, wherein an area is formed where the developer agitating and conveying member is partly exposed out of developer in the direction of developer conveyance by the developer agitating and conveying member, and toner is fed through the toner feed port to the area.

It is a still further object of the present invention to provide an image forming apparatus, including: an image bearing body which bears a latent image; a developing apparatus which develops a latent image formed on the image bearing body, the developing apparatus including: a developer container which holds a two-component developer containing magnetic particles and a carrier; a developer agitating and conveying member which is provided in the developer container to agitate and convey developer; and a toner feed port for feeding toner to the developer container.

These and other objects, features, and advantages of the present invention will be understood more clearly by reading the following detailed description with reference to the drawings.

DETAILED DESCRIPTION OF THE PREFERRED EMBODIMENTS

Figure 1:
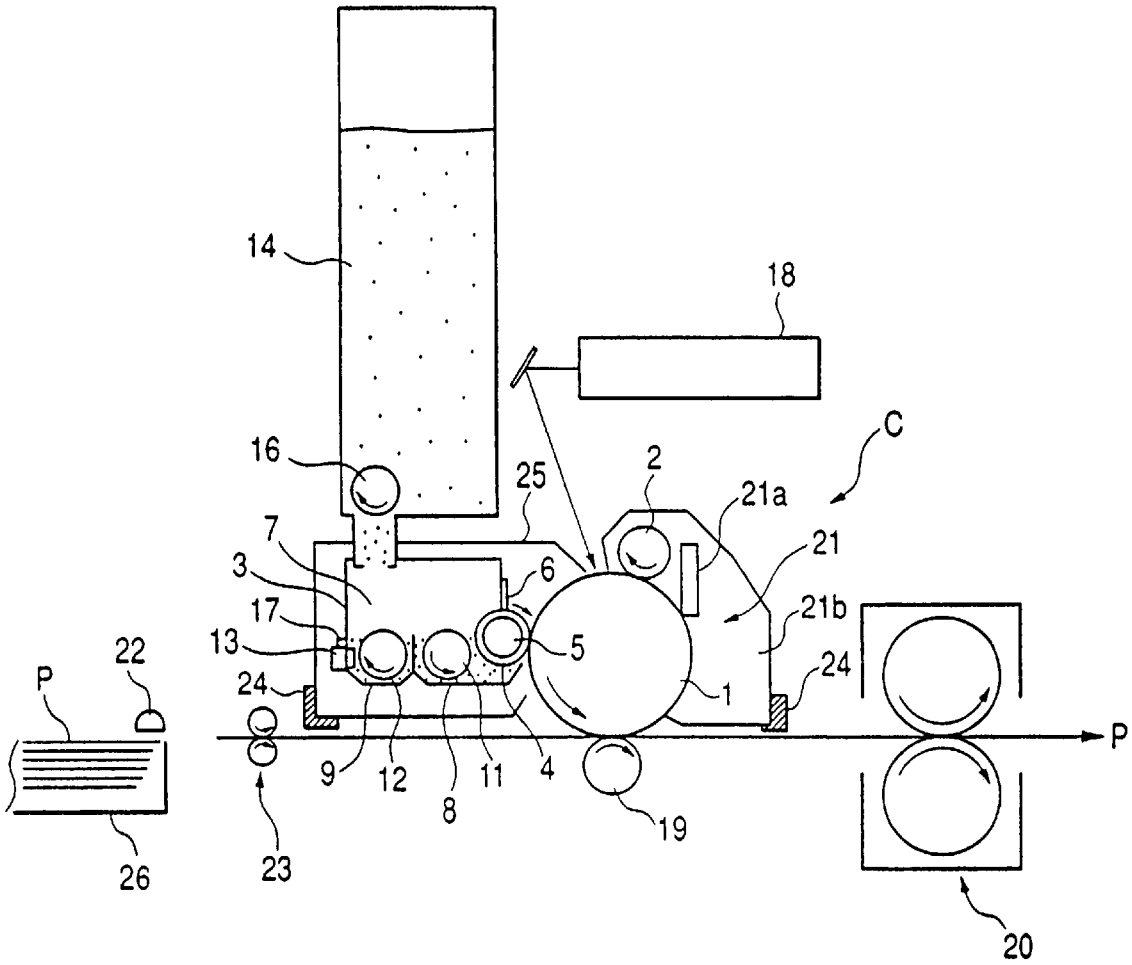
FIG. 1 is a schematic view showing an embodiment of an electronic photograph image forming apparatus to which a process cartridge according to the present invention can be removably attached.

Referring now to the drawings, developing apparatuses, image forming apparatuses, process cartridges, and electronic photograph image forming apparatuses will be described below in detail.

First Embodiment

FIG. 1 is a schematic view of an embodiment of an imaging forming apparatus using a developing apparatus according to the present invention. According to this embodiment, an image forming apparatus is an electronic photograph image forming apparatus which forms an image on a recording medium, using an electronic photograph forming process.

The image forming apparatus in FIG. 1 includes a cylindrical electro-photosensitive body serving as an image bearing body, or a photosensitive drum 1; an electrostatically charging apparatus 2 which charges the photosensitive drum 1; an exposing apparatus 18 which forms an electrostatic latent image on the photosensitive drum 1; a developing apparatus 3 which makes the electrostatic image on the photosensitive drum 1 visible, using developer; a hopper 14, or a toner replenishing apparatus for replenishing the developing apparatus 3 with toner; a transferring apparatus 19 which transfer a toner image formed on the photosensitive drum 1 onto a recording medium P contained in a supply tray; a fixing apparatus 20 which fixes the toner image, transferred onto the recording medium P; and a cleaning apparatus 21 which removes residual toner from the photosensitive drum 1.

An electronic photograph forming process will be described below. An electrostatic latent image is formed on the photosensitive drum 1, using the electrostatic latent image forming means. That is, after the electrostatically charging apparatus 2 uniformly charges the surface of the photosensitive drum 1, the exposing apparatus 18 exposes the surface according to image information to form an electrostatic latent image on the photosensitive drum 1. Then, nonmagnetic toner in a two-component developer, which contains both magnetic particles (carriers) and nonmagnetic toner (toner), is deposited on the electrostatic latent image by the developing apparatus 3 to make it visible as a so-called toner image. The toner image on the photosensitive drum 1 is transferred onto the recording medium P under the action of the transferring apparatus 19, which medium is fed to a transferring unit, consisting of the photosensitive drum 1 and transferring apparatus 19 opposite to each other, at a predetermined time by paper feed means 22 and rollers 23 (recording medium transferring means). Next, the recording medium P is conveyed to the fixing apparatus 20, and the unfixed toner image is fixed on the recording medium P by heat and pressure to provide a permanently fixed image. Finally, the recording medium P is ejected from the image forming apparatus. Residual toner is cleaned off the photosensitive drum 1 by the cleaning apparatus 21, including a cleaning blade 21*a* and a waste toner container 21*b*. The above-described process is repeated to form one image after another.

This embodiment uses a frame 25 to integrate into one the photosensitive drum 1, the electrostatically charging apparatus 2 as process means acting on the photosensitive drum 1, developing apparatus 3, and cleaning apparatus 21, thus providing a process cartridge C which can be removably attached through attaching means 24 installed on the image forming apparatus body.

Figure 2:
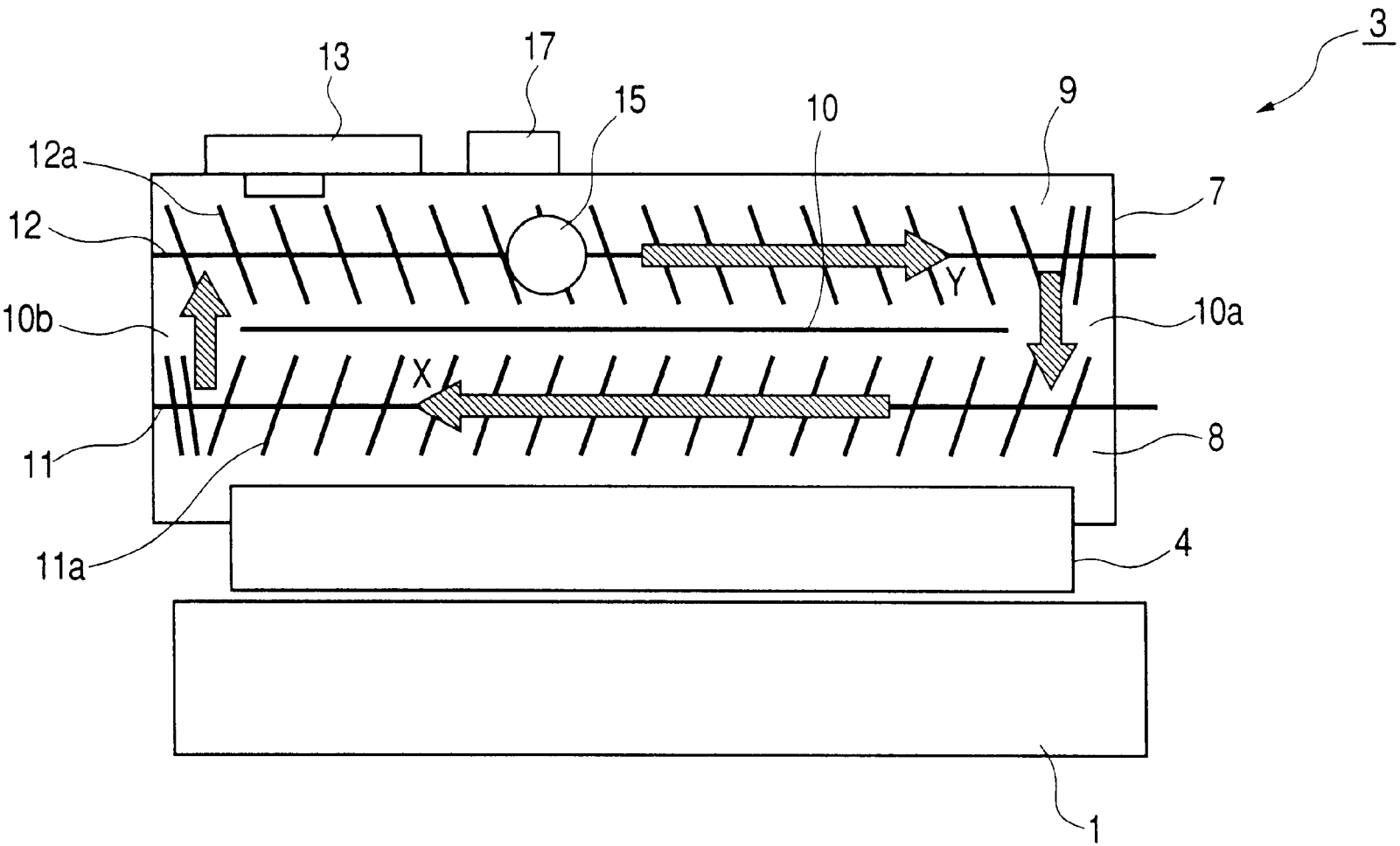
FIG. 2 is a schematic sectional view of an embodiment of a developing apparatus according to the present invention as viewed from above.

Referring now to FIG. 2 also, the developing apparatus 3 of this embodiment will be detailed below. FIG. 2 is a schematic sectional view of the developing apparatus 3 as viewed from-above.

In the developing apparatus 3, a developer container (developer tank) 7 holds a two-component developer containing toner and a carrier. A developing sleeve 4 is provided on the photosensitive drum side of the developer container 7 so that the sleeve 4 is opposite to the photosensitive drum 1. The developing sleeve 4 has a stationary magnet roller 5 inside. The developing sleeve 4, indicated by an arrow in FIG. 1, rotates, so that the developing sleeve 4 attracts developer around it, thus forming a magnetic brush. A restricting blade 6 is provided near the developing sleeve 4 to limit the height of the brush to a certain value and deposit an appropriate amount of toner on an electrostatic latent image on the photosensitive drum 1.

This embodiment uses a negatively charged toner which contains particles 6 $\mu$m in average diameter (weight average diameter) and a magnetic carrier contains particles 35 $\mu$m in average diameter (weight average diameter) and have a saturation magnetization value of 205 emu/cm$^3$. The two-component developer used for this embodiment is a mixture of the toner and carrier at a weight ratio of 8:92.

The developer container 7 has two developer carry paths 8 and 9. A partition wall 10, which is substantially parallel to the direction of the length of the developing sleeve 4, is provided between the first and second carry paths 8 and 9. Openings are provided at both longitudinal ends of the partition wall 10. First and second agitating members (agitating means) 11 and 12 are disposed in the first and second carry paths 8 and 9, respectively. The first and second agitating means 11 and 12 are substantially parallel with the developing sleeve 4. In this embodiment, the first and second agitating members 11 and 12 are conveying screws which include spiral blades 11*a* and 12*a* spirally provided around the periphery of rotating shafts. As shown in FIG. 1, in this embodiment also, the first agitating member 11 rotates counterclockwise and the second agitating member rotates clockwise to agitate developer while conveying it. That is, as shown in FIG. 2, the first and second agitating members convey developer in directions indicated by arrows X and Y, respectively while agitating it.

Giving a further explanation, developer conveyed through the second carry path 9 while being agitated, with toner therein electrostatically charged by friction, is directed through an opening 10*a* provided at a longitudinal end of the partition wall 10 to the first carry path 8 and fed through the first carry path 8 to the developing sleeve 4. At the same time, developer, which has developed an electrostatic latent image formed on the photosensitive drum 1, so that its toner concentration has decreased, returns through an opening 10*b* provided at another longitudinal end of the partition wall 10 to the carry path 9. As described above, developer circulates in the developer container 7.

A toner concentration sensor (toner sensor) 13, means for detecting the amount of toner in developer, also serving as a developer amount detecting means, is disposed near the uppermost part of the carry path 9. That is, the toner concentration sensor is disposed more upstream in the direction of developer conveyance than a toner replenishing opening (toner port) 15 through which toner is replenished as described later. Thus the toner sensor 13 can detect the concentration of toner in developer immediately after it develops an electrostatic latent image on the photosensitive drum 1. In this embodiment, the toner sensor 13 detects toner concentration (mixing ratio of a carrier and toner) by comparing the magnetic permeability of a magnetic carrier with that of toner, containing nonmagnetic toner and a magnetic carrier. The present invention does not limit developer amount detecting means to the toner sensor 13 of this embodiment. Any developer amount detecting means can be used which uses other detecting methods, such as an electrostatic capacity measurement method and a light transmission method.

Through the toner feed port 15, an opening for replenishing toner, which is upstream of the second carry path 9, toner is replenished from the toner replenishing apparatus (hopper) 14. As shown in FIG. 1, a rotating blade 16, a toner feed member, is provided under the hopper 14. The rotating blade 16 rotates to replenish an amount of toner, which is calculated from a given function using a toner concentration detected by the toner sensor 13, so that the carry path 9 is replenished through the toner feed port 15 with toner.

As described above, developer circulates in the developer container 7, and toner is replenished so that a developer with a predetermined concentration of toner is kept fed to the developing sleeve 4.

As described above, to form an image with a uniform density, it is essential to stably feed developer with a uniform toner concentration to the developing sleeve 4. To do so, replenished toner must be agitated in a short time.

The inventors examined conditions under which immediately after it is replenished, toner is thoroughly agitated in a short time, thus providing a uniform toner concentration. As a result, the inventors concluded that the volume of the part of the agitating member, a part which is above the level of developer (hereinafter called the developer surface) in the developer container 7, is a key. For the developing apparatus of this embodiment, it is essential for the second agitating member 12 in the second carry path 9, above which member the toner feed port 15 is provided, to be above the developer surface.

Because of significant difference between specific gravity, the carrier and toner, components of developer, do not mix together. To help the carrier and toner mix well, an agitating member whose agitating performance is enhanced, that is, an agitating member with a spiral blade formed around the periphery of a rotating member or an agitating member with flat ribs extending divergently from a rotating shaft is required. However, because replenished toner floats on developer if toner is replenished when developer covers such an agitating member, it cannot exhibit sufficient agitating performance unless the member is above the level of developer. To obtain a uniform toner concentration in a short time by thoroughly agitating toner, an agitating member must be sufficiently exposed above the developer surface.

Figure 3A:
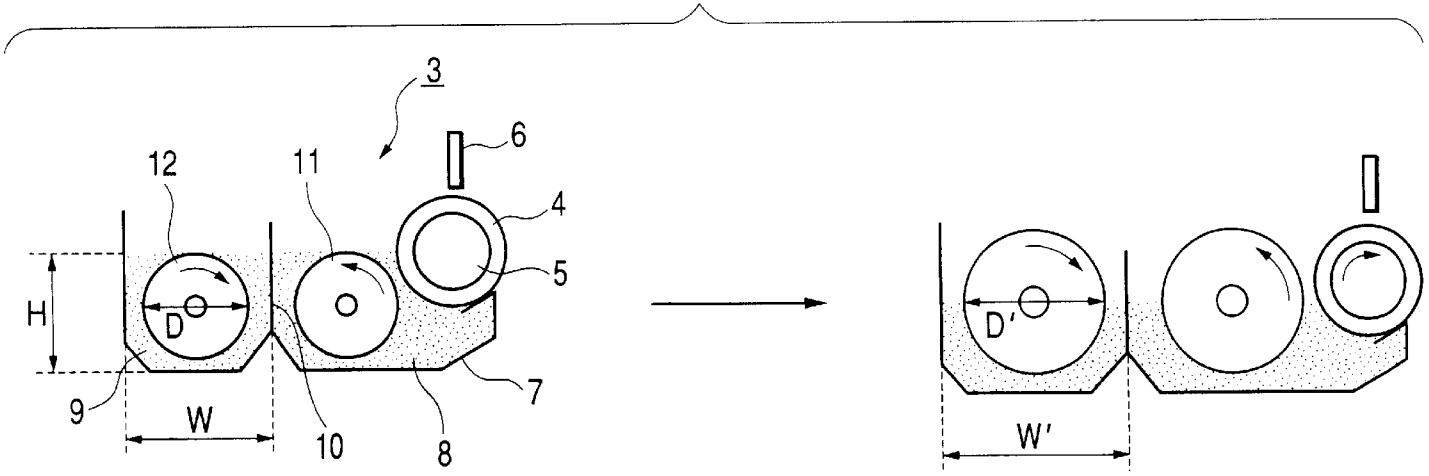
FIGS. 3A and 3B are schematic sectional views illustrating methods for bringing a developer agitating and conveying member out of developer.
Figure 3B:
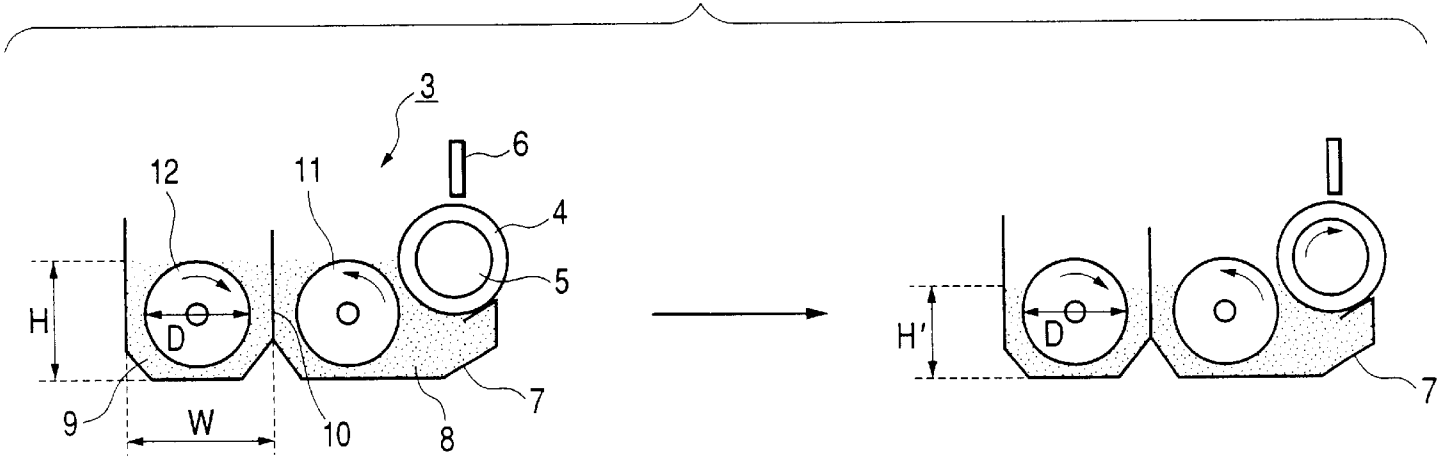

Two methods for significantly increasing the volume of the part of an agitating member above the developer surface are available: one which increases the diameter of the agitating member (i.e., increases the diameter from D to D')

as shown in FIG. 3A, and the other which reduces the level of developer (i.e., reduces the level from H to H') as shown in FIG. 3B.

However, for the method in FIG. 3A, the carry paths 8 and 9 and developer container 7 must also be enlarged (i.e., a width W must be increased to a width W') at the same time the diameters of the agitating members 11 and 12 are increased. The method in FIG. 3A is limited because the developing apparatus and image forming apparatus are reduced in size or a process cartridge is provided.

Reducing the amount of developer as in the case of the method in FIG. 3B makes it difficult to form a satisfactory image. Moreover, reducing the amount of developer inappropriately promotes developer deterioration and prevents developer life from being prolonged to reduce running cost.

According to the present invention, an arrangement is made so that an area where an agitating member is partially above the level of developer and that the area is replenished with toner to made toner and a carrier quickly mix together.

In this embodiment, magnets 17, magnetic field generating means, are provided next to the carry path 9 on an outer surface of the developer container 7 as shown FIG. 2.

Using their magnetism, the magnets 17 make developer containing the toner and carrier partially magnetized and captive. By doing so, an area is produced where the developer surface is changed from its steady state in part in the second carry path 9, thus allowing the second agitating member 12 to be well above the developer surface. Under this condition, developer is agitated while being conveyed, using the second agitating member 12.

Figure 4A:
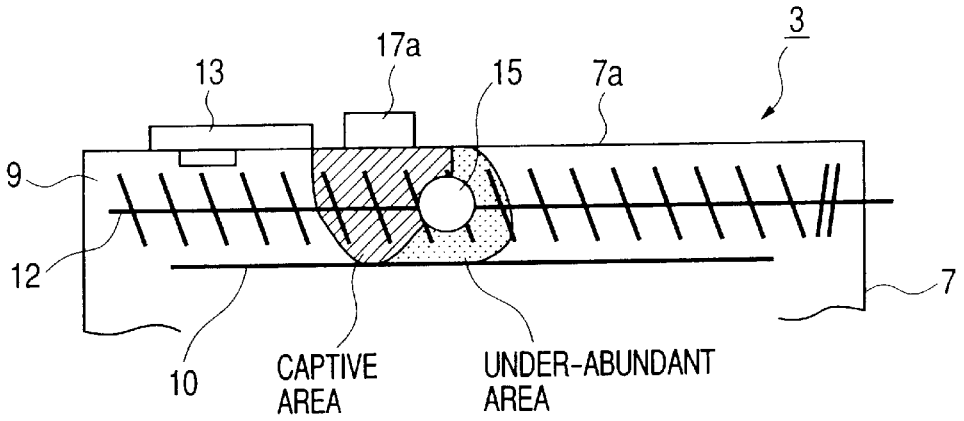
FIG. 4A is a schematic sectional view of an embodiment of a developing apparatus according to the present invention as viewed from above.
Figure 4B:
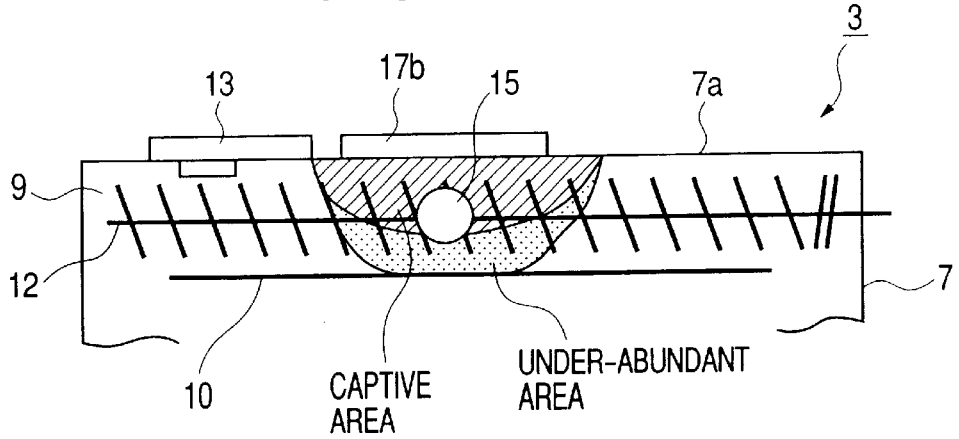
FIG. 4B is a schematic sectional view of another embodiment of the developing apparatus according to the present invention as viewed from above.

More specifically, in this embodiment, the magnets 17 are disposed as shown in FIGS. 4A and 4B. As shown in FIG. 4A, a magnet 17*a* is installed on the outer surface 7*a* of the developer container 7, which surface corresponds to the developer conveyance upstream side of the toner feed port 15. Developer is captive, and thus developer becomes abundant in an area under the effect of the magnetic field produced by the magnet 17*a,* while developer becomes under-abundant on the developer conveyance downstream side of the area where developer is captive. Thus, in the area where developer is under-abundant, the second agitating member 12 is satisfactorily above the developer surface, thus exhibiting sufficient agitating performance. In an arrangement example in FIG. 4A, the toner feed port 15 is positioned so that the developer becomes under-abundant under the action of the magnet 17*a.* This allows toner to be thoroughly agitated immediately after it is replenished, with the result that a uniform toner density is provided in a shorter time than before.

Figure 5:
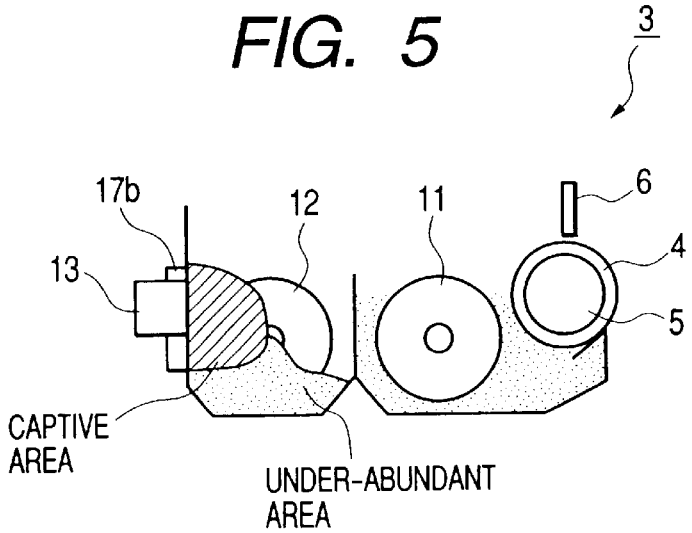
FIG. 5 is a schematic sectional view of a developing apparatus with a developer surface inclined.

In an arrangement example in FIG. 4B, a magnet 17*b,* which is loner than the magnet 17*a* in the direction of developer conveyance used in the configuration of FIG. 4A is used so that the magnetic field of the magnet 17*b* has an effect on a larger area covering the toner feed port 15. In this case, best selecting the magnetism and position of the magnet 17*b* allows the developer surface to be angled as shown in FIG. 5. Angling appropriately the developer surface in the second carry path in such a manner allows the magnet 17*a* side area where developer is captive and abundant and the area away from the magnet 17*b* where developer is under-abundant to be formed and part of the second agitating member 12 to be well above the developer surface. Replenishing the area with toner allows a uniform toner density to be provided in a short time.

In this way, appropriately selecting magnets 17 so that they can generate a magnetic field sufficient to make developer captive, their shape, and their positions allows an area of any length where an agitating member is well above the developer surface to be formed. For example, making long part of the second agitating member 12 well above the developer surface in the direction of developer conveyance as shown in FIG. 4B allows sufficient agitating performance to be provided even if much toner is replenished.

As understood from the foregoing, the present invention does not limit the magnets 17 but allows them to be selected appropriately. For example, the magnitude of a magnetic field on the magnets can be made equal to that of a magnetic field produced by the magnet roller 5 in the developing sleeve 4. This embodiment uses rectangular permanent magnets which produce a magnetic field with a magnitude (magnetic flux density) of about 900 gasses.

Not only permanent magnets but electromagnets which are adapted to produce an appropriate electric field can be used as electric field producing means. This embodiment can be adapted so that the magnitude of a magnetic field produced by magnetic field producing means and the shape of an area covered by the magnetic field are changed as necessary.

For this embodiment, the following comparative tests were performed to confirm the advantages of the present invention.

Using the developing apparatus of this embodiment in FIGS. 4A and 4B and a developing apparatus having no magnets 17 as a comparative example, toner concentration was measured at points along the length of the second carry path 9 when developer was agitated and conveyed by replenishing toner through the toner feed port 15 while the second agitating member 12 was driven. The toner sensor 13 and a like toner sensor were used as described above to obtain toner concentration by measuring the magnetic permeability of developer.

Figure 6:
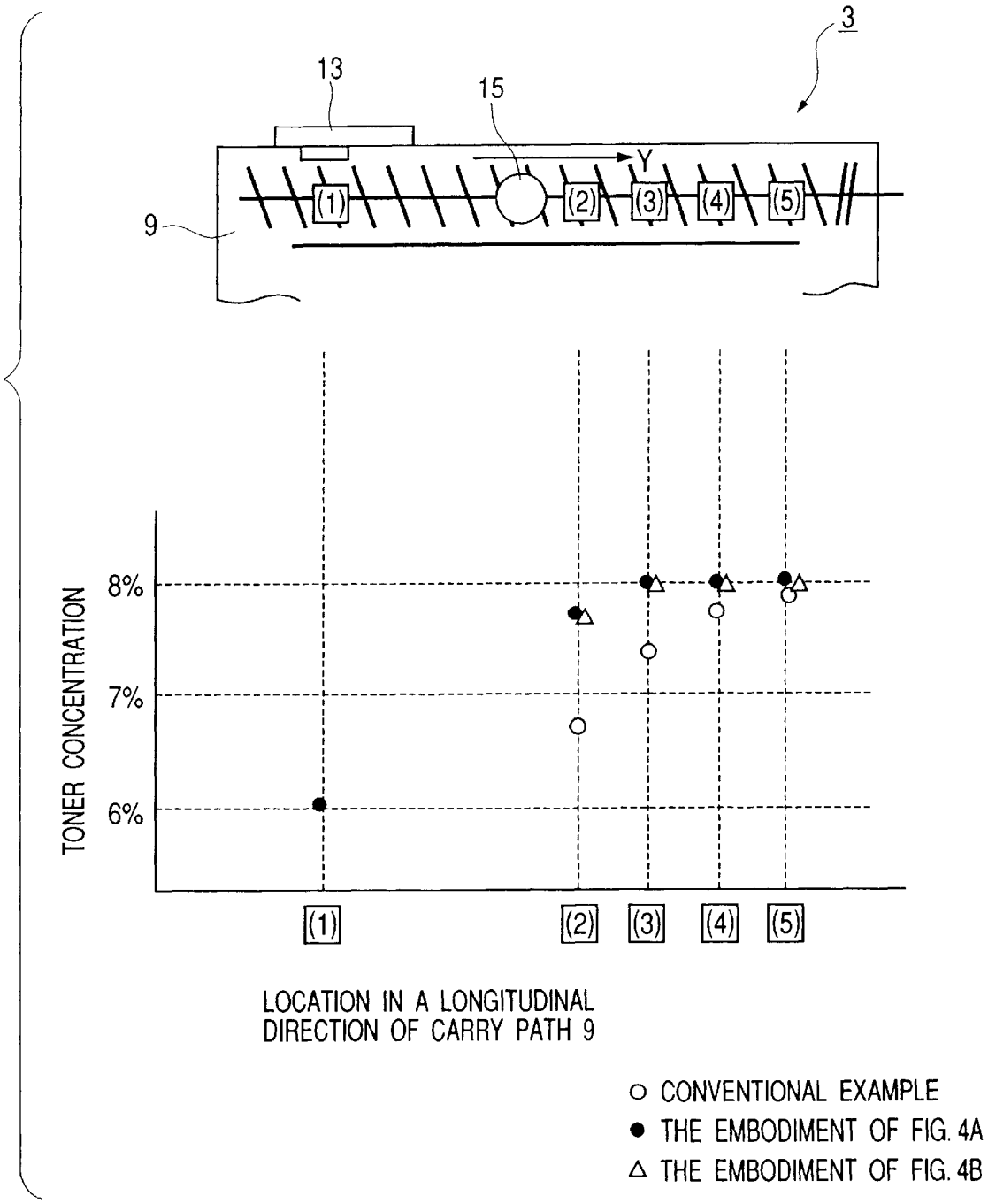
FIG. 6 is a graph showing the results of toner concentration measurements made at points in the direction of developer conveyance in a developer container in a developing apparatus according to the present invention and a comparable example.

Developer was placed in the first and second carry paths of the developing apparatus of this embodiment and the comparative developing apparatus to the extent that the first and second agitating members were almost covered with developer, with the magnets 17 not in use. Developer to be fed to the developing sleeve 4 contained about 8% toner (ratio of the carrier to toner=8:92). When toner concentration decreased to about 6% near the uppermost part of the second carry path in the direction of developer conveyance, developer was conveyed while being agitated, and toner was replenished. FIG. 6 shows the results.

It will be understood from FIG. 6 that the developing apparatus 3 of this embodiment in FIGS. 4A and 4B thoroughly agitated toner in a short time immediately after it was replenished. Thus toner mixes with developer in an extremely short time, resulting in a developer with a uniform toner concentration, so that the developing sleeve 4 can be supplied with such a developer.

When an image was formed using an image forming apparatus with the developing apparatus 3 of this embodiment in FIGS. 4A and 4B, a good final image free from uneven image density could be obtained.

Because the problem of insufficient developer agitation was solved, detecting toner concentration, with the carrier and toner separated from each other did not cause the toner sensor 13 to malfunction.

As described above, according to the present invention, a two-component developer can thoroughly be agitated in a short time, thus allowing a developer with a uniform toner concentration to be fed to the developing sleeve 4. Moreover, incorrect toner concentration detection by the toner sensor 13 can be prevented by agitating a two-component developer fast.

Figure 7:
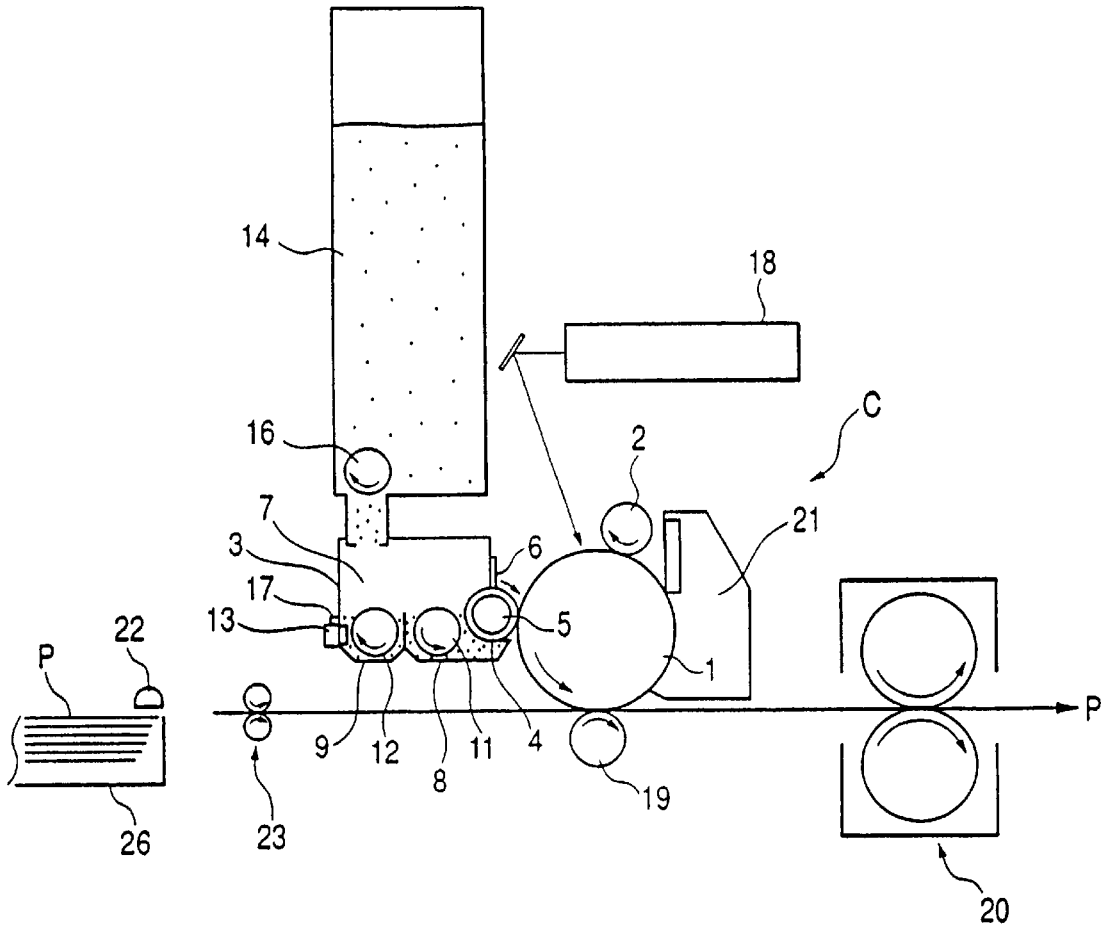
FIG. 7 is a schematic view of another embodiment of an image forming apparatus according to the present invention.
Figure 8:
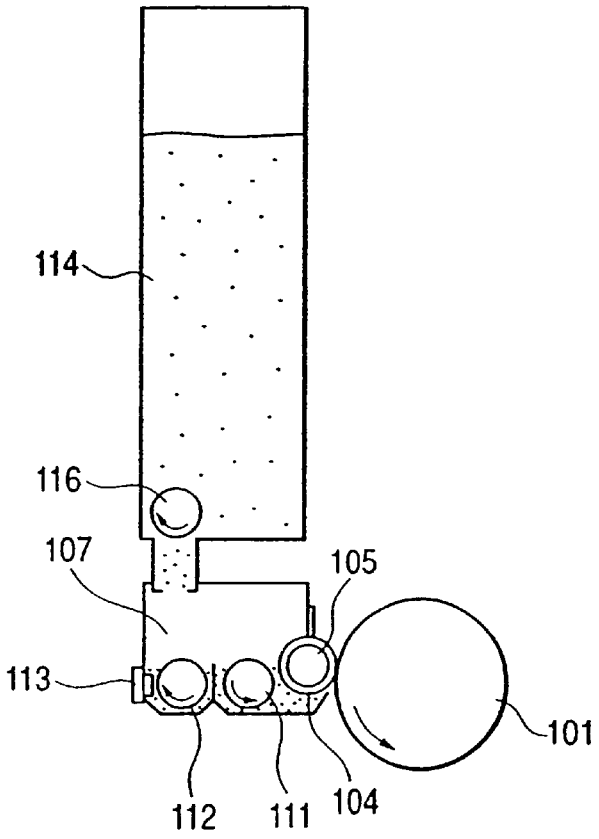
FIG. 8 PRIOR ART
FIG. 8 is a schematic sectional view of an example of a conventional developing apparatus.

In the above-described embodiment, the image forming apparatus is a process cartridge type electronic photograph image forming apparatus. However, the present invention is not limited to such an electronic photograph image forming apparatus. However, the present invention is not limited to such an electronic photograph image forming apparatus yet, of course, for example, as shown in FIG. 7 applies to an image forming apparatus with a developing apparatus secured to its body, to which image forming apparatus toner is fed from a toner replenishing apparatus. In FIG. 7, like reference numbers are given to members which function and are arranged in the same way as in the case of the image forming apparatus in FIG. 1.

It should be understood that the present invention can also apply to an image forming apparatus whose body can be removably fitted through attaching means installed on the body with a developing apparatus configured as a cartridge. In this case, in FIG. 1, the frame 25 is used to integrate the photosensitive drum 1, electrostatic charging apparatus 2, developing apparatus 3, and cleaning apparatus 21 into the process cartridge C, which can be removably attached through the attaching means 24 to the image forming apparatus body. On the contrary, in the above-described case, it should be understood that only the developing apparatus 3 can be removably attached through like attaching means to the image forming apparatus body.

As described above, because the developing apparatus, image forming apparatus, process cartridge, and electronic photograph image forming apparatus of this embodiment, which include the developer containing magnetic particles and toner, developer agitating and conveying members agitating and conveying developer in the developer container, toner feed port for feeding toner to the developer container, are adapted so that an area where part of the developer agitating and conveying members are out of developer in the direction of developer conveyance by the developer agitating and conveying members, in which area is replenished through the toner feed port with developer, the two-component developer can thoroughly be agitated in a short time, thus allowing developer with a uniform toner concentration to be fed to a developer bearing body. Moreover, a two-component developer can be thoroughly agitated in a short time, the developer amount detecting means can be prevented from malfunction. Thus the present invention allows a high-quality image free from defects to be formed at any time.

Second Embodiment

The second embodiment is characterized in that the magnetic field producing means exercises control to intermittently feed electric power to the magnets 17, or the electromagnets, at least during toner replenishment when an image forming apparatus with the developing apparatus 3 described in relation to the first embodiment is used to form an image. The same components are given the same reference numerals as in the first embodiment. Descriptions of these components are omitted.

As described the first embodiment, the toner sensor 13 senses "toner is empty" that toner in the developer container is below a predetermined level when image forming causes toner in the developer to be consumed. The rotating blade 16, a toner feed member which is provided under the hopper 14 to feed an amount of toner predetermined according to a detected toner concentration, rotates to feed toner through the toner replenishing port 15 to the carry path 9 in the developing apparatus 3.

During toner replenishment, the magnetic field producing means intermittently supplies electric power to the magnets 17, or electromagnets, in synchronism with rotation of the rotating blade 16, or a toner feed member. In the second embodiment, electric power is repeatedly supplied at 0.2-second intervals. However, this embodiment is not limited to such a way of supplying electric power.

Because developer, containing a carrier and toner, is partially made captive under the action of the magnetism of the magnets 17 during power supply, toner is throughly agitated in a short time immediately after it is replenished. In contrast, when no electric power is supplied, developer is freed as magnetism disappears, and freed developer is conveyed down the carry path 9 by the agitating and conveying member 12.

Thus developer in an area which is under the effect of a magnetic field produced by the magnets 17, or electromagnets, is allowed to be replaced until electric power is fed again. Moreover, developer is prevented from being captive in part during toner replenishment, and developer can be agitated and conveyed more stably.

In the above-described arrangement, fed toner mixes with developer in an extremely short time, thus providing a developer with a uniform toner concentration. Thus a developer with a uniform toner concentration can stable be fed to the developing sleeve 4, so that a good final image free from uneven density can be obtained.

Because the problem of insufficient developer agitation was solved, detecting toner concentration, with the carrier and toner separated from each other did not cause the toner sensor 13 to malfunction.

As described above, according to the second embodiment, a two-component developer can be throughly agitated in a short time, thus allowing a developer with a uniform toner concentration to be fed to the developing sleeve 4. Moreover, incorrect toner concentration detection by the toner sensor 13 can be prevented by agitating a two-component developer fast.

The image forming apparatus according to the second embodiment is described above as a process cartridge type electronic photograph image forming apparatus. However, the present invention is not limited to such an electronic photograph image forming apparatus.

The second embodiment can also apply to an image forming apparatus whose body can be removably fitted through attaching means installed on the body with a developing apparatus configured as a cartridge.

Third Embodiment

Figure 9:
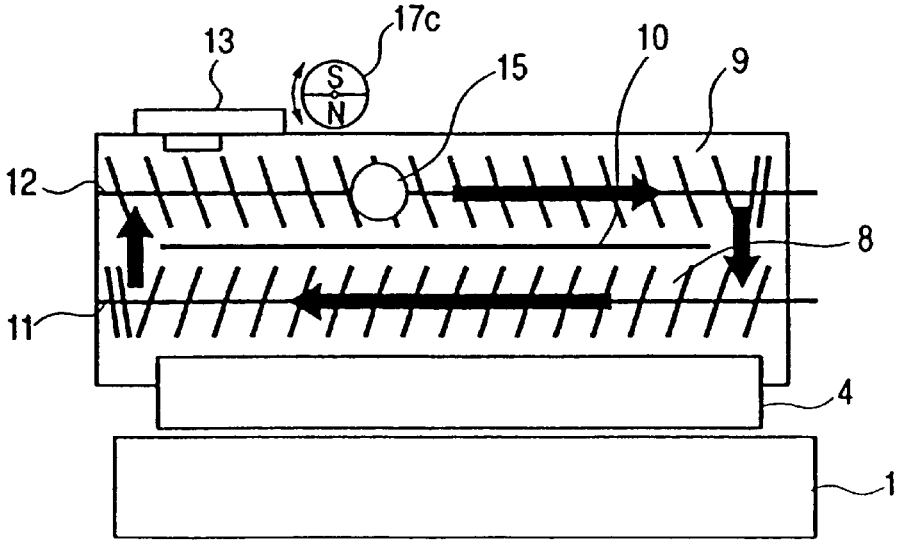
FIG. 9 is a schematic top view of the major parts of a developing apparatus according to a third embodiment of the present invention.

In contrast to the second embodiment, the third embodiment of the present invention is characterized in that a magnet 17*c* is rotatably disposed next to the carry path 9 outside the developing apparatus 3, using movable supporting means as shown in FIG. 9. The same components are given the same reference numerals as in the second embodiment. Descriptions of these components are omitted.

Figure 10A:
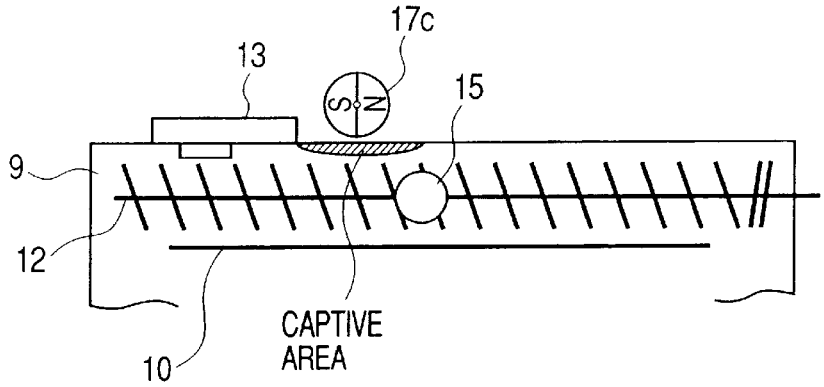
FIGS. 10A, 10B, and 10C are schematic views illustrating an example of arrangement of magnets in a developing apparatus according to the third embodiment and their operation.
Figure 10B:
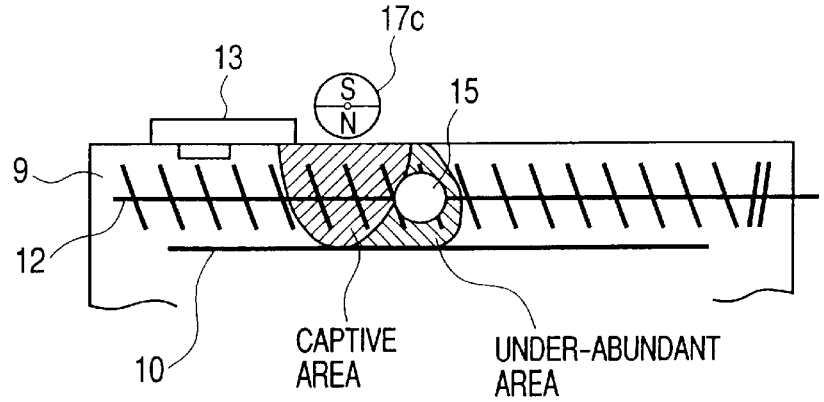

As shown in FIGS. 10A and 10B, the magnet 17*c* can be secured in two positions (the first and second positions) by rotation. Because developer is made weakly captive under the action of the magnetism of the magnet 17*c*, the developer surface is not positively changed.

When the magnet 17*c* is in the position in FIG. 10B, its magnetism makes developer partially captive, thus forming areas (captive and under-abundant areas) where the developer surface in the carry path 9 is changed from its steady state.

Figure 10C:
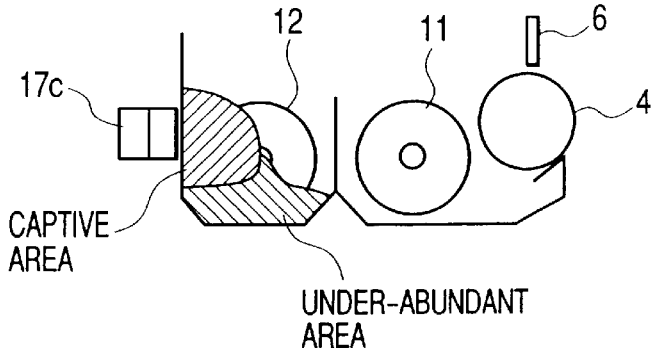

Thus the agitating and conveying member 12 allowed to be well above the developer surface in the under-abundant area as shown in FIG. 10C. Feeding toner through the toner feed port 15, positioned in the under-abundant area, from the hopper 14 allows toner and the carrier to be thoroughly agitated, thus conveying a developer with a uniform toner concentration in a shorter time than before.

The state in FIGS. 10B and 10C is effective if it is created at least only during toner replenishment, so the steady state in FIG. 10A is kept during normal operation to free developer from the captive area.

For a conventional developing apparatus, a toner and a carrier flow into the carry path 8 due to durability operation or environmental changes before they mix well together, thus causing an uneven image density or the like, while this embodiment, even in the same condition, allows toner fed to mix with developer in an extremely short time and the resulting developer with a uniform toner concentration to be fed to the developing sleeve 4, thus preventing an uneven image density. This embodiment does not separate toner from a carrier during durability operation, so that the toner sensor is prevented from malfunctioning, thus providing a good image.

As described above, the present invention provides a developing apparatus, a process cartridge, and an image forming apparatus with the developing apparatus or process cartridge which can thoroughly agitate a two-component developer in a short time to feed the developer to a developing sleeve, with its toner concentration even.

In this embodiment, the magnets 17*c*, or magnetic field producing means, are rotatably disposed to be secured in two positions. However, the present invention is not limited to such an arrangement.

Figure 11A:
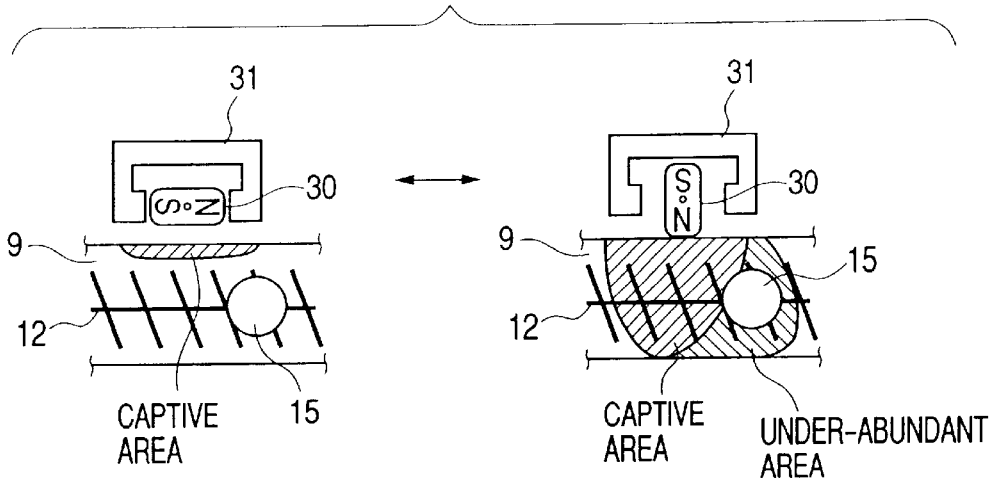
FIGS. 11A, 11B, 11C, and 11D are schematic views illustrating another example of arrangement of the magnets according to the third embodiment of the present invention and their operation.

That is, as shown in FIG. 11A, a magnetic circuit can be formed around a magnet 30, using a member 31 with a high magnetic permeability to prevent the magnetism of the magnet from making developer captive as far as possible at the position where any toner replenishment is not performed. Such a configuration is advantageous to an image forming apparatus which is required to be reduced especially in size.

Figure 11B:
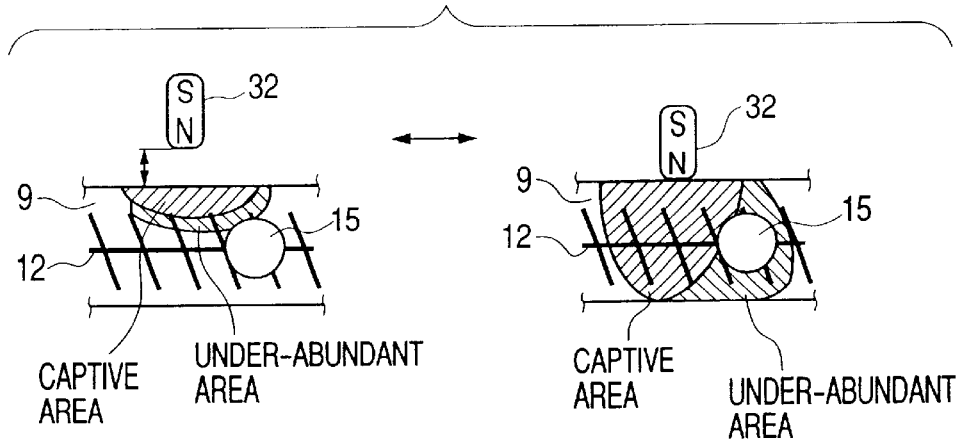

As shown in FIG. 11B, a magnet 32 can be disposed so that it can move in the direction of distance. Thus bringing the magnet 32 close to the developing apparatus at least during toner replenishment allows the same advantages to be provided as in the case of the first embodiment.

Figure 11C:
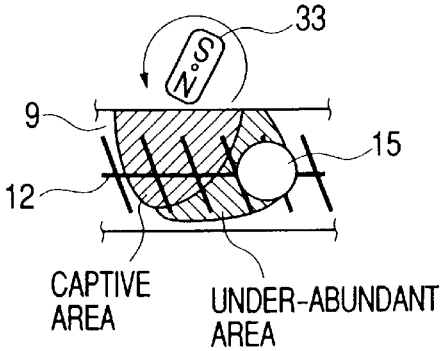
Figure 11D:
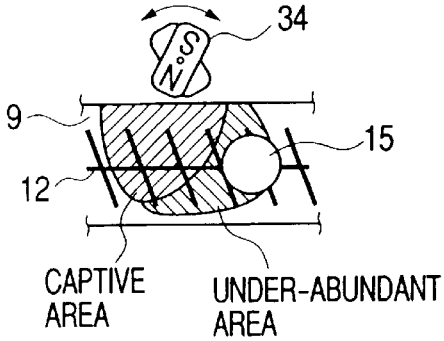

As shown in FIGS. 11C and 11D, magnets 33 and 34 can be continuously or intermittently rotated or swung at least during toner replenishment, thus allowing an agitation effect to be additionally exhibited at the replenishing port by changing the developer surface. If the magnets are rotated, this embodiment can be adapted so that captive developer is replaced every time the magnet 33 rotates.

In the embodiments described above, rotation is made in a horizontal plane. However, if magnetism acting on developer is changed by rotation, rotation may be made in a vertical plane, a plane angled to a horizontal plane, or the like, with no special limitations on rotation. In the first embodiment, the magnets are secured in two positions: active and inactive. In addition to these positions, a plurality of positions may be provided as in the case of swing in FIG. 11B to agitate developer and cope with difference in the amount of toner fed.

As described above, because this embodiment has an exposing means for bringing part of the developer agitating and conveying member out of developer in the developer container, the developer can be agitated and conveyed in a short time, thus allowing the developer to be fed to a developer bearing body, with its toner concentration even, so that an apparatus can be provided which stably forms a high-quality image free from defects at any time.

By making the developer captive using magnetic field producing means, the exposing means can bring part of the developer agitating and conveying member out of developer in the developer container without failing to throughly agitate the developer in a short time. This allows residual-developer amount detecting means to be prevented from malfunctioning, so that a highly reliable apparatus can be provided.

What is claimed is:

1. A developing apparatus, comprising:

a developer container which holds a two-component developer containing magnetic particles and toner;

a developer agitating and conveying assembly is provided in said developer container to agitate and convey developer; and a toner feed port for feeding toner to said developer container, wherein an area is formed where said developer agitating and conveying assembly is partly exposed out of developer in the direction of developer conveyance by said developer agitating and conveying assembly, and toner is fed through said toner feed port to the area where said developer agitating and conveying assembly is partly exposed out of the developer.

2. The developing apparatus according to claim 1, wherein the apparatus has magnetic field producing means, wherein a magnetic field produced by said magnetic field producing means attracts developer, thus forming the area where said developer agitating and conveying assembly is partly exposed out of the developer.

3. The developing apparatus according to claim 2, wherein said magnetic field producing means includes electromagnets performing as magnetic field producing sources.

4. The developing apparatus according to claim 2, wherein said magnetic field producing means can optionally control magnetic field generation.

5. The developing apparatus according to claim 4, wherein said magnetic field producing means produces a magnetic field at least when a toner feed means feeds toner.

6. The developing apparatus according to claim 2, further comprising movable supporting means, which movably supports said magnetic field producing means.

7. The developing apparatus according to claim 6, wherein said movable supporting means disposes said magnetic field producing means in a first position when toner is being fed and in a second position, differing from said first position when toner is not being fed.

8. The developing apparatus according to claim 6, wherein said movable supporting means continuously or intermittently changes a position of said magnetic field producing means during toner feeding.

9. The developing apparatus according to claim 1, wherein said developer agitating and conveying assembly, includes:

a first developer agitating and conveying member positioned at a developer bearing body in said developer container; and a second developer agitating and conveying member positioned opposite to the developer bearing body with respect to the first developer agitating and conveying member, wherein said first agitating and conveying member conveys developer substantially in parallel with the direction of the axis of a developer bearing body while agitating the developer, and said second agitating and conveying member is partly exposed out of the developer.

10. The developing apparatus according to claim 9, wherein each of said first and second developer agitating and conveying members includes a rotating shaft provided with a spiral blade around said rotating shaft.

11. The developing apparatus according to claim 1, wherein said developing apparatus, which is integrated with an image bearing body, bearing a latent image, into a process cartridge, can removably be attached to an image forming apparatus body.

12. The developing apparatus according to claim 1, wherein said toner feed port is provided substantially above the area where said developer agitating and conveying assembly is partly exposed out of the developer.

13. An image forming apparatus, comprising:

an image bearing body which bears a latent image;

a developing apparatus which develops a latent image formed on said image bearing body, the developing apparatus including:

a developer container which holds a two-component developer containing magnetic particles and a carrier;

a developer agitating and conveying assembly, which is provided in said developer container to agitate and convey developer; and a toner feed port for feeding toner to said developer container, wherein an area is formed where part of said developer agitating and conveying assembly is out of developer in a direction of developer conveyance by said developer agitating and conveying assembly, and toner is fed through said toner feed port to the area where said developer agitating and conveying assembly is partly exposed out of the developer.

14. The image forming apparatus according to claim 13, further comprising magnetic field producing means, and a magnetic field produced by the magnetic field producing means attracts developer, thus forming an area where said developer agitating and conveying assembly is partly exposed out of the developer.

15. The image forming apparatus according to claim 14, wherein said magnetic field producing means includes electromagnets performing as magnetic field producing sources.

16. The image forming apparatus according to claim 14, wherein said magnetic field producing means can optionally control magnetic field generation.

17. The image forming apparatus according to claim 16, wherein said magnetic field producing means produces a magnetic field at least when toner feed means feeds toner.

18. The image forming apparatus according to claim 14, further comprising movable supporting means, which movably supports said magnetic field producing means.

19. The image forming apparatus according to claim 18, wherein said movable supporting means disposes said magnetic field producing means in a first position when toner is being fed and in a second position, differing from the first position, when toner is not being fed.

20. The image forming apparatus according to claim 18, wherein said movable supporting means continuously or intermittently changes the position of said magnetic field producing means during toner feeding.

21. The image forming apparatus according to claim 13, wherein said developer agitating and conveying assembly, includes:

a first developer agitating and conveying member positioned at a developer bearing body in said developer container; and a second developer agitating and conveying member positioned opposite to said developer bearing body with respect to said first developer agitating and conveying member, wherein the first agitating and conveying member conveys developer substantially in parallel with the direction of the axis of said developer bearing body while agitating the developer, and said second agitating and conveying member is partly exposed out of the developer.

22. The image forming apparatus according to claim 21, wherein each of said first and second developer agitating and conveying members includes a rotating shaft provided with a spiral blade around said rotating shaft.

23. The image forming apparatus according to claim 13, wherein said developing apparatus, which is integrated with the image bearing body, bearing a latent image, into a process cartridge, can removably be attached to an image forming apparatus body.

24. The image forming apparatus according to claim 13, wherein said toner feed port is provided substantially above the area where said developer agitating and conveying assembly is partly exposed out of the developer.

* * * * *

UNITED STATES PATENT AND TRADEMARK OFFICE

CERTIFICATE OF CORRECTION

PATENT NO. : 6,415,125 B1
DATED : July 2, 2002
INVENTOR(S) : Shinya Yamamoto et al.

It is certified that error appears in the above-identified patent and that said Letters Patent is hereby corrected as shown below:

Title page,
Item [57], ABSTRACT,
Line 4, “throughly” should read -- thoroughly --.

Column 2,
Line 35, “preferably” should read -- preferable --.

Column 4,
Line 39, “transfer” should read -- transfers --.

Column 5,
Line 15, “from-above” should read -- from above --.

Column 7,
Line 19, “made” should read -- make --; and
Line 52, “loner” should read -- longer --.

Column 8,
Line 15, “gasses.” should read -- gausses. --.

Column 9,
Lines 7 and 8, “However, the present invention is not limited to such an electronic photograph image forming apparatus yet,” should be deleted;
Line 9, “of course, for example, as shown in FIG. 7 applies to” should read -- For example, FIG. 7 shows --; and
Line 60, “described” should read -- described in --.

Column 10,
Line 28, “stable be” should read -- be stably --; and
Line 36, “throughly” should read -- thoroughly --.

UNITED STATES PATENT AND TRADEMARK OFFICE

CERTIFICATE OF CORRECTION

PATENT NO. : 6,415,125 B1
DATED : July 2, 2002
INVENTOR(S) : Shinya Yamamoto et al.

It is certified that error appears in the above-identified patent and that said Letters Patent is hereby corrected as shown below:

Column 11,
Line 25, “malfunctioning;” should read -- malfunctioning, --.

Signed and Sealed this

Thirty-first Day of December, 2002

JAMES E. ROGAN
*Director of the United States Patent and Trademark Office*